US005251798A

United States Patent [19]

Theodore

[11] Patent Number: 5,251,798

[45] Date of Patent: Oct. 12, 1993

[54] WEAPON HOLSTERS HAVING ONE-PIECE CONSTRUCTION

[75] Inventor: Paris Theodore, New York, N.Y.

[73] Assignee: Thundercloud Corporation, Wilmington, Del.

[21] Appl. No.: 984,842

[22] Filed: Dec. 3, 1992

Related U.S. Application Data

[62] Division of Ser. No. 837,968, Feb. 20, 1992, Pat. No. 5,209,383.

[51] Int. Cl.[5] ..... F41C 33/00

[52] U.S. Cl. ..... 224/193; 224/192; 224/253; 224/911; 224/912

[58] Field of Search ..... 224/191, 192, 193, 253, 224/911, 912

[56] References Cited

U.S. PATENT DOCUMENTS

| | | | |
|---|---|---|---|
| 837,156 | 11/1906 | Townsend . | |
| 2,347,006 | 4/1944 | Tibbetts . | |
| 2,434,380 | 1/1948 | Williams | 224/911 X |
| 3,008,617 | 11/1961 | Villwock . | |
| 3,128,926 | 4/1964 | Stella . | |
| 3,731,858 | 5/1973 | Baker | 224/911 X |
| 3,942,692 | 3/1976 | Chica . | |
| 4,044,929 | 8/1977 | Caruso . | |
| 4,062,481 | 12/1977 | Clark | 224/243 |
| 4,143,798 | 3/1979 | Perkins | 224/243 |
| 4,398,655 | 8/1983 | Perry | 224/191 |
| 4,544,089 | 10/1985 | Tabler | 224/192 |
| 4,577,787 | 3/1986 | Hersey | 224/243 |
| 4,741,465 | 5/1988 | Johnson . | |
| 4,759,482 | 7/1988 | Olsen | 224/238 |
| 5,018,653 | 5/1991 | Shoemaker | 224/198 |

FOREIGN PATENT DOCUMENTS

| | | | |
|---|---|---|---|
| 1012108 | 6/1977 | Canada | 224/192 |
| 1012109 | 6/1977 | Canada | 224/911 X |

OTHER PUBLICATIONS

Pistol and Revolver Digest, Grennell, Dean A., 1976, p. 218, Follet Publishing Company, Chicago, Ill.

*Primary Examiner*—Allan N. Shoap
*Assistant Examiner*—Stephen K. Cronin
*Attorney, Agent, or Firm*—Oliff & Berridge

[57] ABSTRACT

Weapon holsters of substantially stitchless, one-piece construction provide tension on the surface of weapons held therein. The holsters further facilitate release of weapons held therein for quick removal by the holster wearers. Shoulder, pocket and belt holsters are provided, each holster being constructed so as to facilitate concealment of a weapon held therein. The shoulder holster comprises outer and inner faces which define openings for receipt of a weapon. The weapon's barrel or forwardmost slide portion, grip and hammerspur or grip tang protrude from different openings, the weapon's barrel or forwardmost slide portion pointing in an upward direction and the weapon grip pointing in a direction substantially perpendicular to the upward direction. As the weapon grip is held and pivoted by the holster wearer, the corresponding pivoting of the barrel or forwardmost slide portion causes separation of portions of the outer and inner faces to enable release of the weapon. The pocket holster comprises outer and inner faces which define an upper opening through which a weapon is inserted into the holster and a lower opening through which a weapon's barrel or forwardmost slide portion extends. The inner face which faces the wearer's body comprises at least one arm. An upper edge of the arm defines a rest upon which a face of a weapon cylinder or a front strap of a trigger guard sits. The belt holster comprises outer and inner faces defining upper and lower openings for receipt of a weapon, the weapon's barrel or forwardmost slide portion extending through the lower opening. Slots are provided in the outer and inner faces for receipt of a belt. The faces cooperate to cause friction between the holster and belt to provide constant tension on the weapon surface.

10 Claims, 11 Drawing Sheets

WEAPON HOLSTERS HAVING ONE-PIECE CONSTRUCTION

This is a division of application No. 07/837,968 filed Feb. 20, 1992, now U.S. Pat. No. 5,209,383.

BACKGROUND OF THE INVENTION

1. Field of the Invention

The present invention relates to weapon holsters and, more particularly, to shoulder, pocket and belt holsters having one-piece construction.

2. Description of the Related Art

Weapon holsters commonly require a variety of features to make them desirable to a holster wearer. A holster should tightly engage a weapon held therein to prevent inadvertent slippage of the weapon. The holster should provide a concealable silhouette so that the weapon therein is not readily visible. The holster should facilitate access to the weapon so that the holster wearer can simply reach for the weapon and pull it out of the holster quickly.

Difficulties exist in designing holsters which provide both secure retention and concealment of weapons while facilitating quick removal of weapons from the holsters. Commonly, a holster wearer must sacrifice a less desirable feature of a weapon holster in order to obtain a weapon holster having features most desirable to the wearer.

U.S. Pat. No. 2,347,006 to Tibbetts discloses a forward draw spring holster which is worn on a belt. The holster wearer is enabled to shoot a gun without raising the gun from the holster. The holster requires a spring grip for gripping and holding the gun in a normal position.

U.S. Pat. No. 4,143,798 to Perkins discloses a holster including a structure for preventing wear on the firearm caused by repeated contact with the holster. The structure must be released to free the gun for release from the holster.

U.S. Pat. No. 3,128,926 discloses a one-piece belt holster. The holster provides neither concealment of the gun nor tight retention of the gun.

U.S. Pat. No. 4,741,465 to Johnson discloses a pocket holster which conceals a gun held therein. In order to release the gun, the wearer must push on a metal bar to cause release of a hook so that the wearer can pull the gun out of the holster.

U.S. Pat. No. 837,156 to Townsend discloses a holster which can be attached to or detached from the clothing or belt of a wearer. The holster does not provide concealment of the gun.

U.S. Pat. No. 3,008,617 discloses a belt holster including magnets which cooperate to hold holster edges together. The holster provides no concealment or tight retention of the weapon.

U.S. Pat. No. 4,062,481 to Clark discloses a belt holster comprising a pair of assemblies connected to opposite sides of a gun receiving pocket. The holster provides no concealment of the gun held therein.

U.S. Pat. No. 3,942,692 to Chica discloses a belt holster formed of one piece of leather folded symmetrically along a front edge. The gun is released by grasping the butt and using a clockwise pivoting motion to remove the gun. A leaf spring is used to secure the gun in the holster.

U.S. Pat. No. 4,577,787 to Hersey discloses a belt holster comprising matching pieces of material stitched together interior to their lateral edges. The holster has symmetry such that it can be utilized by a right or left handed wearer.

U.S. Pat. No. 3,731,858 to Baker discloses a belt holster made of identical leather pieces joined in overlying relationship. The gun pocket is formed by stitching arranged so that a pocket diverges from the bottom to the top of the holster.

U.S. Pat. No. 4,044,929 to Caruso discloses a holster belt comprising an elongated belt member having converging lines of stitching, one of the stitching lines being curved to provide a concave depression for a trigger guard. The holster does not provide sufficient tension on the gun's surface to adequately retain the gun therein.

OBJECTS AND SUMMARY OF THE INVENTION

An object of the present invention is to provide weapon holsters which provide sufficient tension on weapon surfaces to tightly retain weapons therein.

Another object of the present invention is to provide weapon holsters which adequately conceal the weapon's presence.

Another object of the present invention is to provide weapon holsters which enable quick access to weapons held therein by the holster wearers.

A further object of the present invention is to provide weapon holsters which are simple and economical to manufacture.

To achieve the foregoing and other objects and to overcome the shortcomings discussed above, shoulder, pocket and belt holsters of substantially stitchless, one-piece construction are provided. The shoulder holster comprises outer and inner faces which define openings for receipt of a weapon. The inner face is positioned adjacent to the holster wearer's body while the outer face is positioned away from the holster wearer's body. The weapon's barrel or forwardmost portion of the semiautomatic's slide, grip, and hammerspur or semiautomatic's grip tang each protrude from different holster openings, the weapon's barrel or forwardmost slide portion pointing in an upward direction and the weapon grip pointing in a direction substantially perpendicular to the upward direction. As the weapon's grip is held and pivoted by the holster wearer, the corresponding pivoting of the barrel or forwardmost slide portion causes separation of portions of the outer and inner faces to enable release of the weapon.

The pocket holster comprises outer and inner faces which define an upper opening through which a weapon is inserted into the holster and a lower opening which accepts a weapon's barrel or a forwardmost portion of a weapon's slide. The inner face, facing the wearer's body, comprises at least one arm. An upper edge of the arm defines a rest upon which a revolver's cylinder face or the front strap of a semi-automatic's trigger guard sits.

The belt holster comprises outer and inner faces defining upper and lower openings for receipt of a weapon, the weapon barrel extending through the lower opening. Slots are provided in the outer and inner faces for receipt of a belt. In one embodiment, tabs may extend from the outer and inner faces, the tabs causing friction between the holster and belt to provide constant tension on the weapon surface. In another embodiment, the faces cooperate to cause friction between the holster and belt to provide constant tension on the weapon surface.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

Figures 1A, 2:
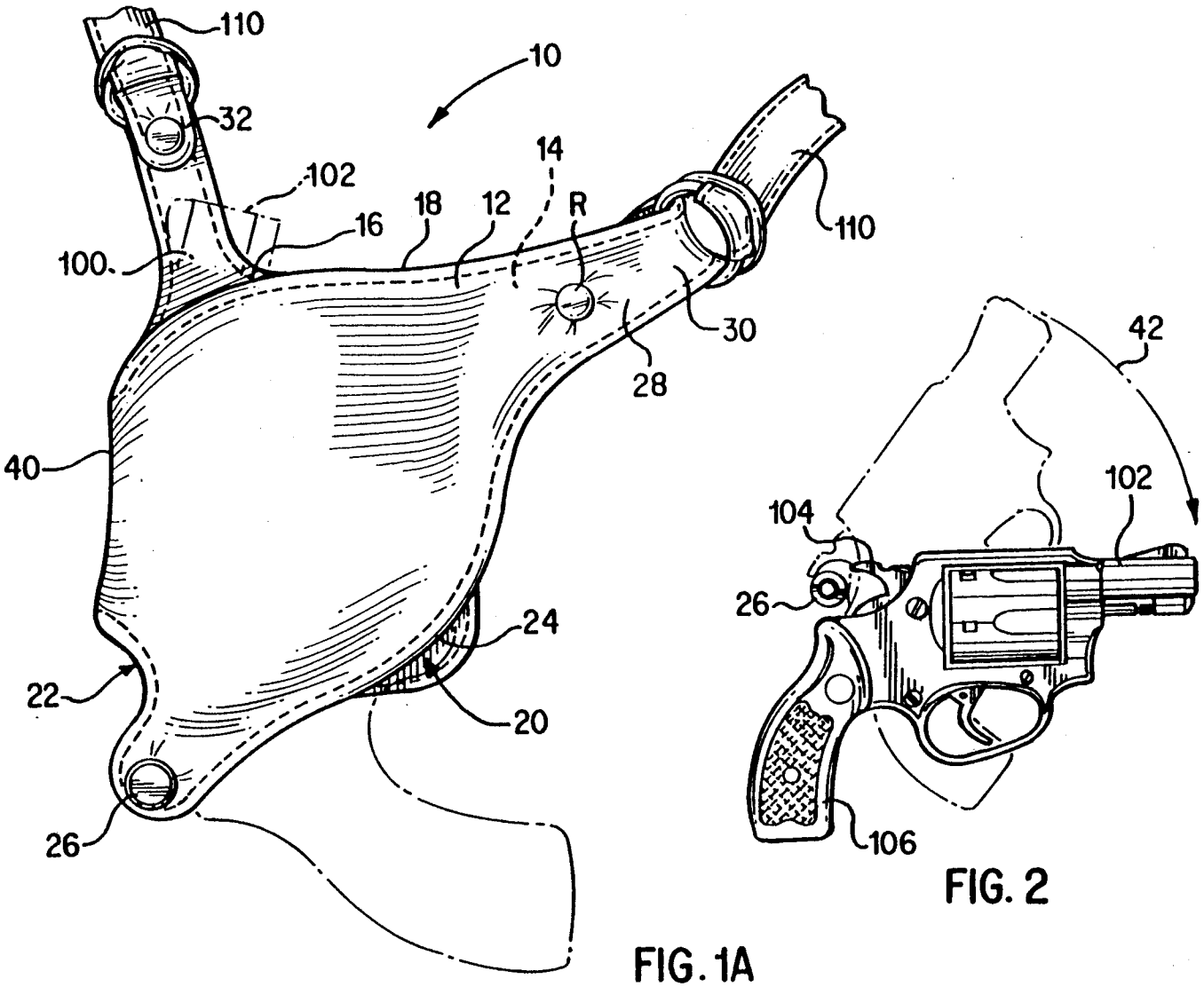
FIG. 1A illustrates a front view of a shoulder holster in accordance with the present invention.
FIG. 2 illustrates the motion induced on a weapon held in the FIG. 1 holster to enable removal of the weapon from the holster.
Figure 1B:
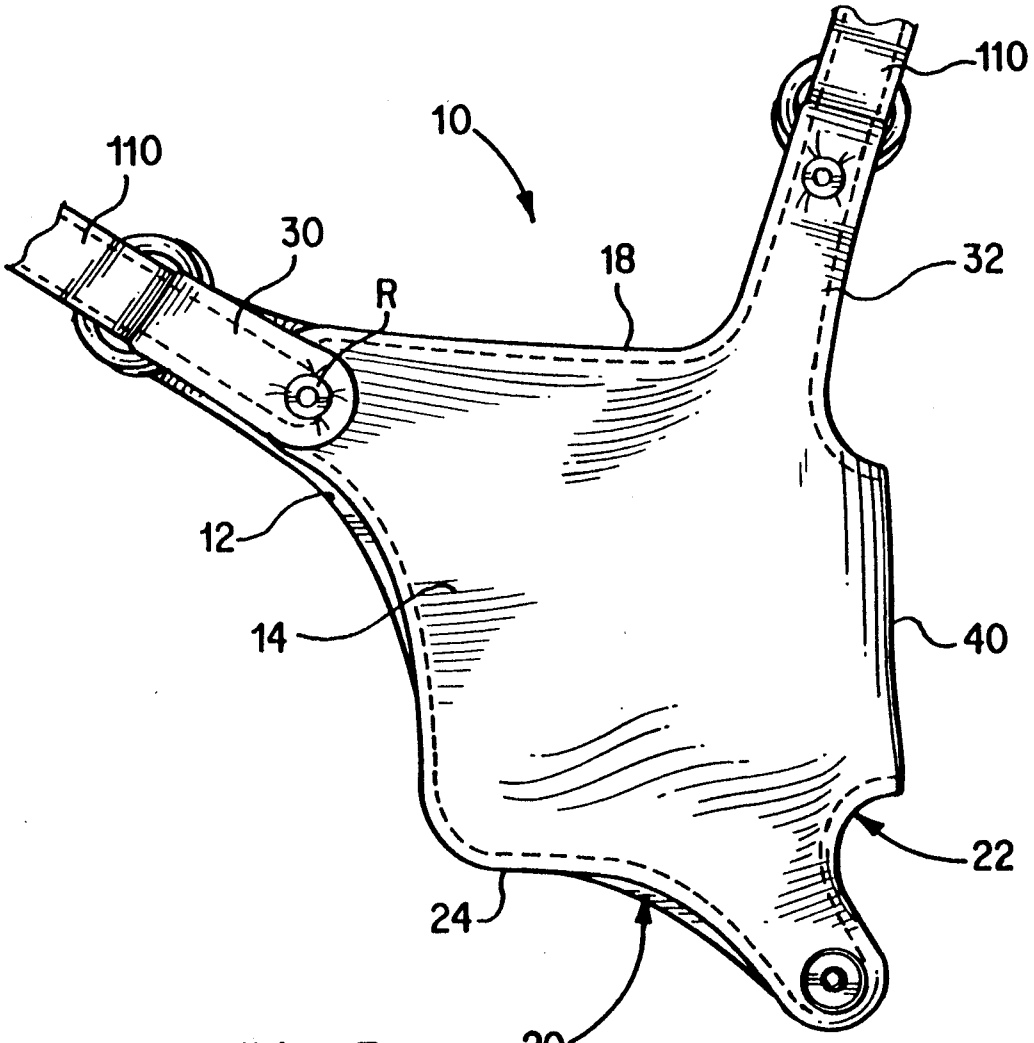
FIGS. 1B-1D illustrate rear, front and bottom views, respectively, of the shoulder holster in accordance with the present invention.
Figure 1C:
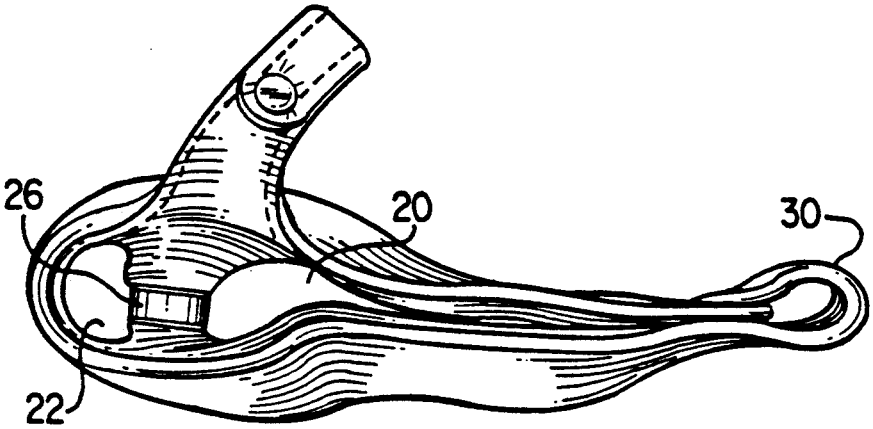
Figure 1D:
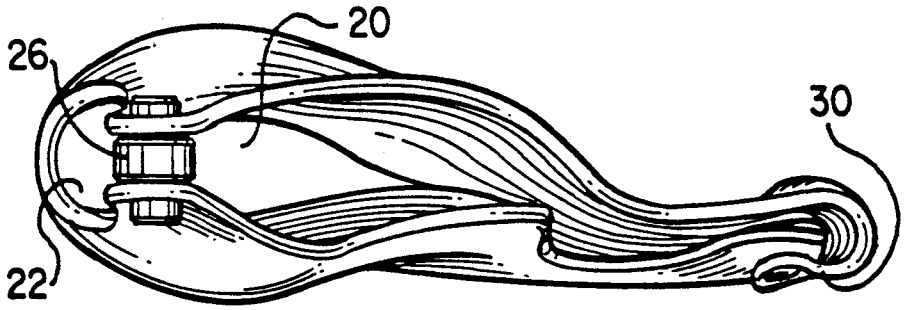

Referring now to the drawings, and particularly to FIGS. 1A-1E and 2 thereof, a shoulder holster 10 is described.

Shoulder holster 10 comprises an outer face 12 and an inner face 14. Outer and inner are defined with respect to the holster wearer's body. A gap is provided between an inward facing surface of outer face 12 and an outward facing surface of inner face 14, the gap being provided for receipt of a weapon 100.

As illustrated in FIGS. 1A-1E, an upper edge portion 18 of outer face 12 and inner face 14 defines a first opening 16 through which a weapon's barrel 102 or a forwardmost portion of a semi-automatic's slide extends.

A lower edge portion 24 of outer face 12 and inner face 14 defines a second opening 20 through which weapon 100 is inserted and removed from holster 10. Opening 20 is larger than opening 16 to accommodate the grip 106 of the weapon 100.

A third opening 22 defined by another area of lower edge portion 24 of outer face 12 and inner face 14 is provided to accommodate a weapon's hammerspur or semiautomatic's grip tang 104 (generically referred to as the hammer or firing pin housing areas).

A spacer 26 extends between outer face 12 and inner face 14 at a location between grip opening 20 and opening 22, thus providing a separation between openings 20 and 22. When weapon 100 is positioned within holster 10, the weapon's hammerspur or grip tang 104 rests on spacer 26.

Outer face 12 includes a tab 30 extending therefrom between upper edge 18 and lower edge 24. Tab 30 has an end which is fastened to an inward facing surface of inner face 14, preferably by a fastening means. A shoulder strap 110 or similar means may also be connected to shoulder holster 10 by tab 30.

Inner face 14 includes a tab 32 extending beneath opening 16. Tab 32 has an end fastened to the surface of inner face 14. A portion of strap 110 is connected to tab 32.

Outer and inner faces 12 and 14 can comprise a single piece of folded material, e.g., folded planar sheet material, the material being folded along a fold line 40 between the hammerspur and barrel, or grip tang and forwardmost slide portion openings 22 and 16. One such material is a sheet of leather. Alternatively, outer and inner faces 12 and 14 can comprise a different type of sheet material such as injection molded plastic. When holster 10 is worn, tabs 30 and 32 are pulled tightly by strap 110. Simultaneously, the weight of weapon 100 provides a downward pulling force on holster 10. The combined pulling forces cause holster 10 to bend around the wearer's upper torso, causing outer and inner faces 12 and 14 to be positioned in close relationship to one another. As outer and inner faces 12 and 14 are pulled closely together, a constant tension is provided on weapon 100 resulting in retention of the position of the weapon within holster 10. The natural resiliency of the material used for outer and inner faces 14 conforms to the shape of the wearer's upper body and to the shape of the weapon, while concealing the presence of the weapon therein.

A closure 28 can further be provided on an inward facing surface of outer face 12 and an outward facing surface of inner face 14 between the barrel or forwardmost slide portion and grip openings 16, 20. Closure 28 can comprise, for example, cooperating hook and loop material such as VELCRO which permits the outer and inner faces 12, 14 to be separated from each other upon movement of the barrel or forwardmost slide portion through the closure. Alternatively, closure 28 can comprise, for example, a material such as plastic. The plastic would have properties enabling retention of the position of outer and inner faces 12 and 14 close to one another to close the opening 16 and hold the barrel or forwardmost slide portion 102 in the opening 16. In order to release the weapon, sufficient force would have to be applied to separate the plastic members whose natural resiliency would allow passage of the barrel or forwardmost portion of the slide 102. Any type of closure 28 can thus selectively be used to further ensure that outer and inner faces 12 and 14 are held in close relationship to one another when the holster is worn and weapon 100 is held therein. This secures the weapon within the holster by tightly closing the barrel or forwardmost slide portion opening 16 about the barrel 102 or forwardmost slide portion.

When the holster wearer desires to remove weapon 100 from holster 10, as illustrated in FIG. 2, the wearer reaches for the grip 106 of weapon 100 and pivots the weapon as indicated by arrow 42, the pivoting motion of barrel or forwardmost slide portion 102 moving the barrel or forwardmost slide portion 102 through the closure 28, thereby causing a separation of outer and inner faces 12 and 14 along upper edge portion 18. Hammerspur or grip tang 104 can then, after a desmodromic revolution, rotate off of and become separated from spacer 26, enabling the removal of weapon 100 through the lower grip opening 20 and out of holster 10. Until the rotation is applied, the weapon is securely retained in its position within holster 10 and is not released until desired by the holster wearer.

Figure 1E:
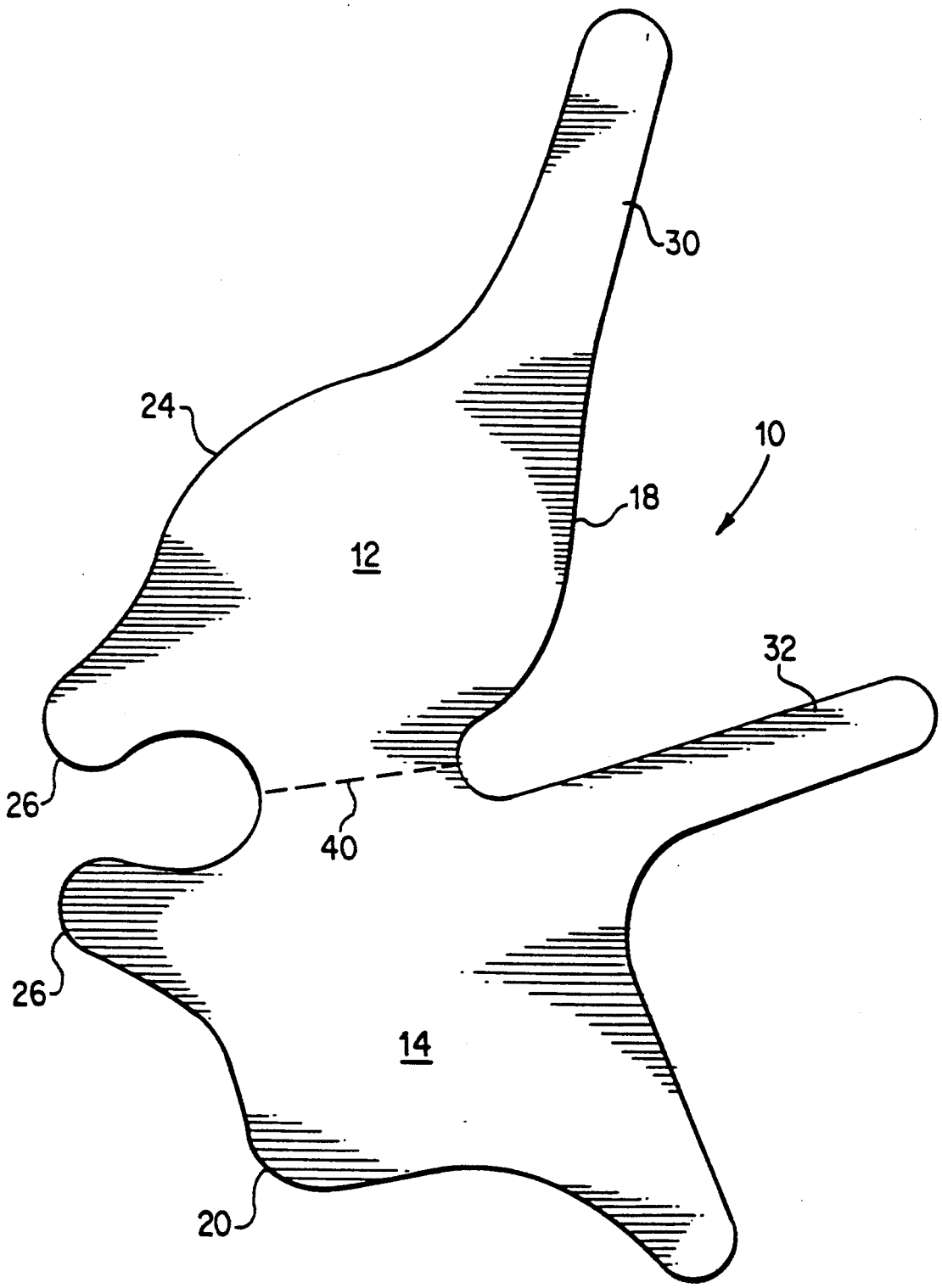
FIG. 1E illustrates a plan view of the shoulder holster of FIGS. 1A-1D.

FIG. 1E illustrates a "face" side of a right-handed version of the shoulder holster 10.

Figure 4:
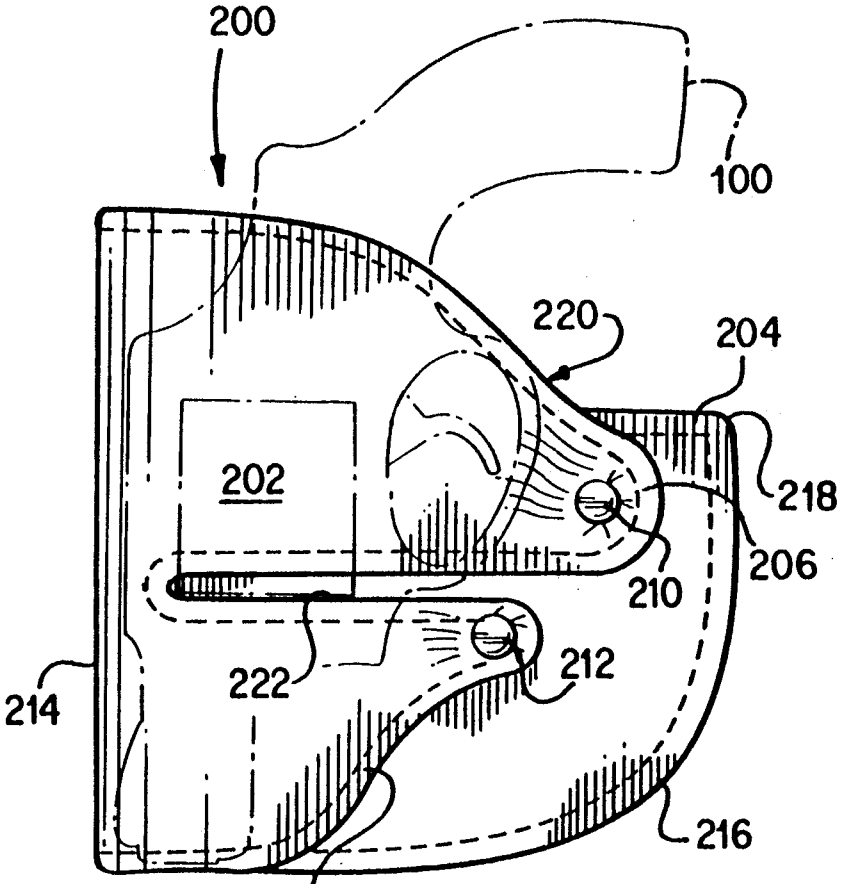
FIG. 4 illustrates a rear view of a pocket holster in accordance with the present.
Figure 3:
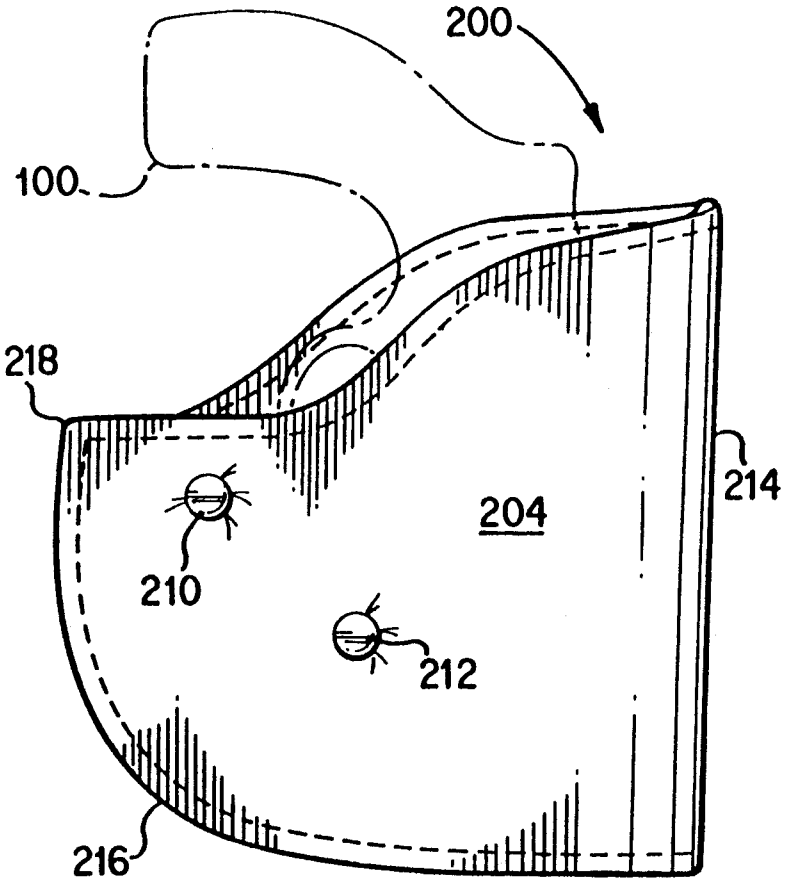
FIG. 3 illustrates a front view of a pocket holster in accordance with the present invention.
Figure 5:
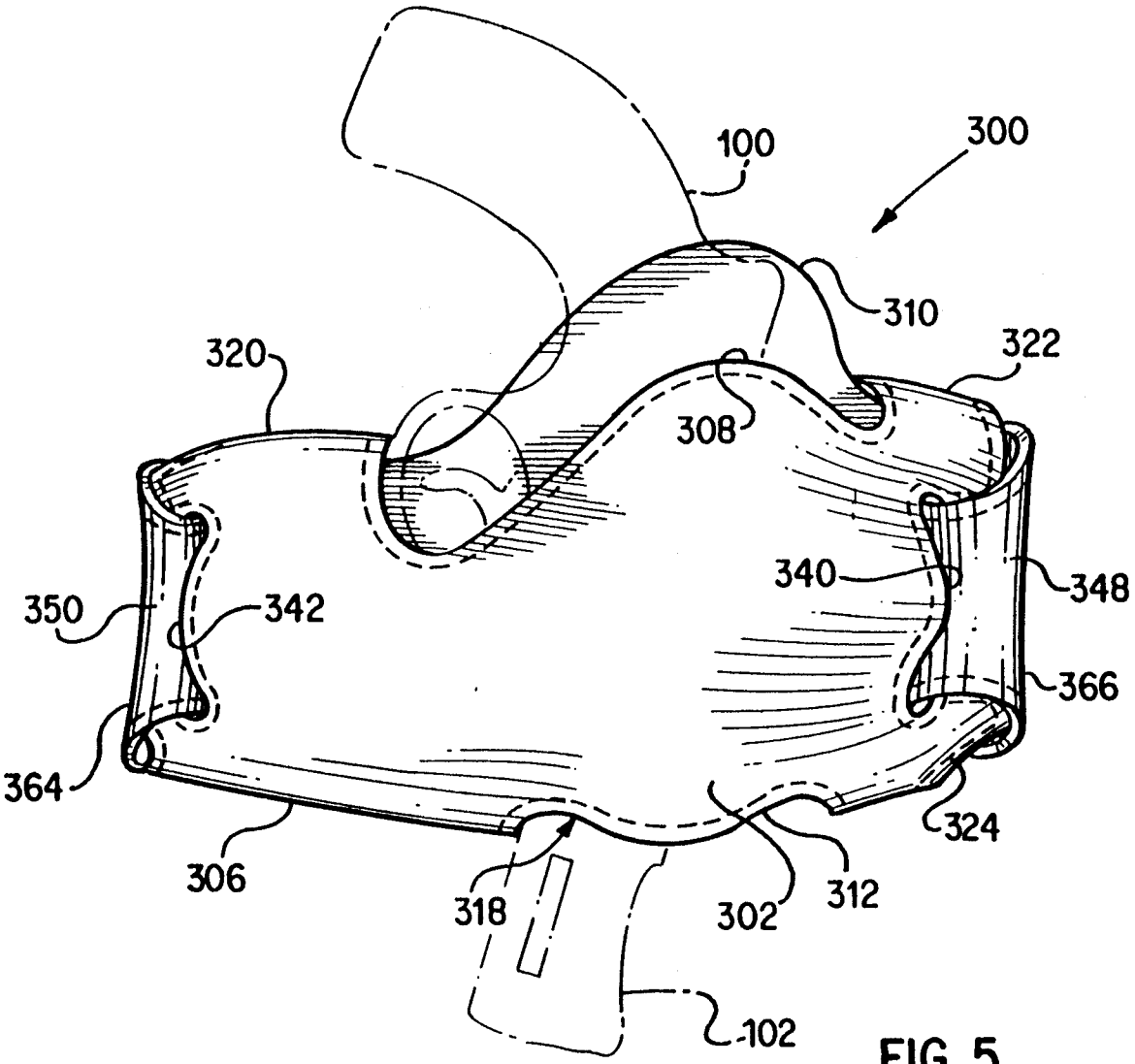
FIG. 5 illustrates a front view of a belt holster in accordance with the present invention.
Figure 6:
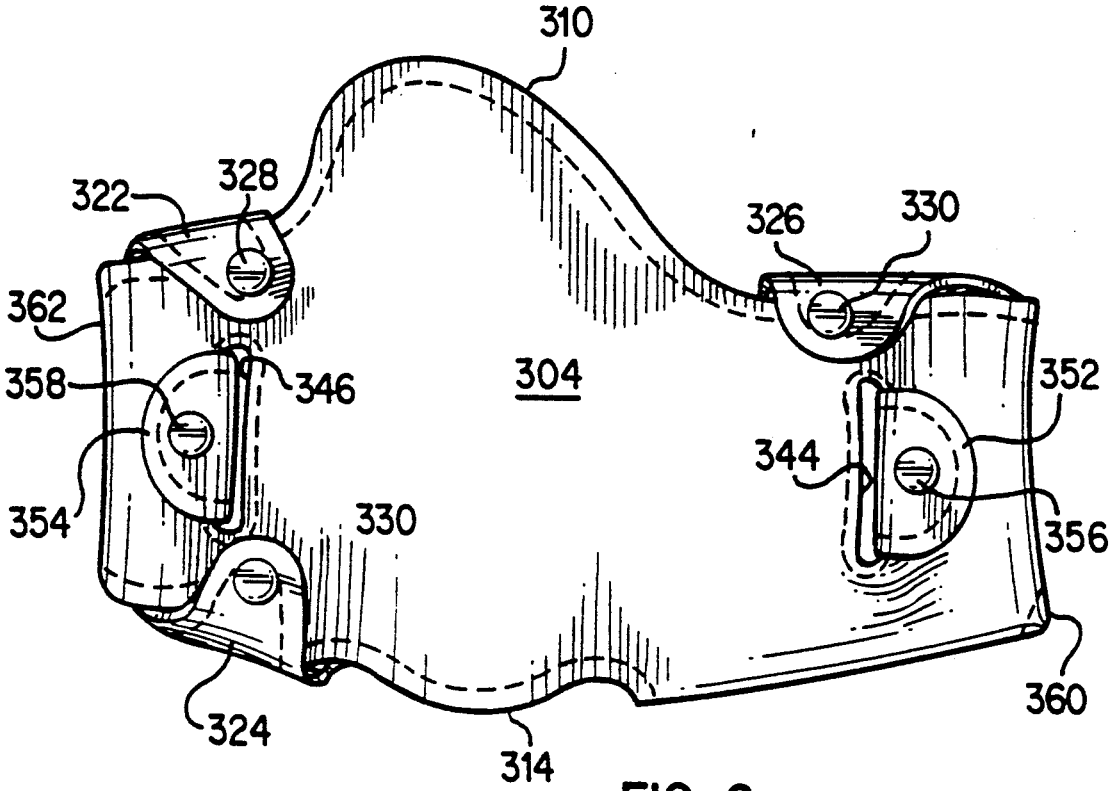
FIG. 6 illustrates a rear view of a belt holster in accordance with the present invention.
Figure 7:
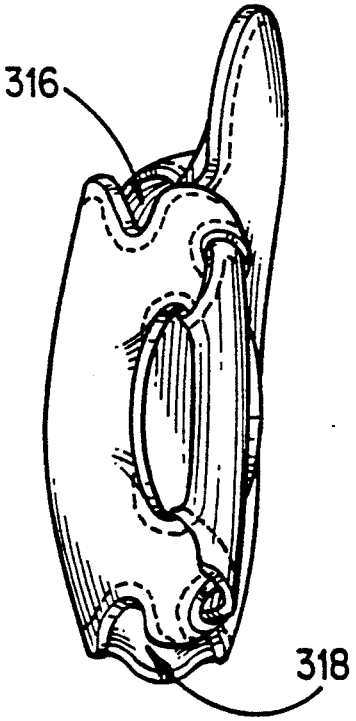
FIG. 7 illustrates a side view of a belt holster in accordance with the present invention.
Figure 8:
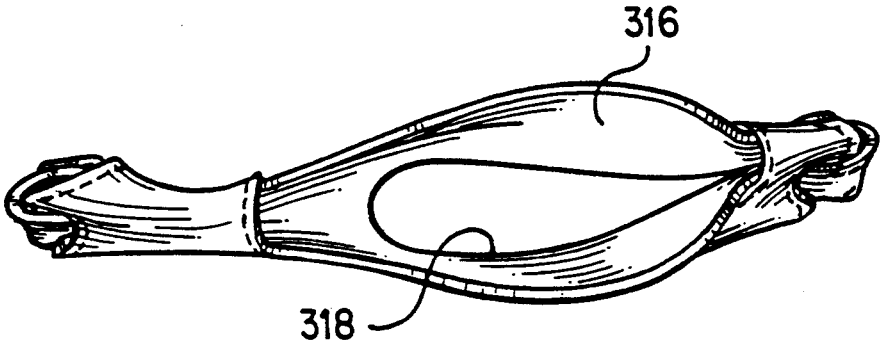
FIG. 8 illustrates a top view of a belt holster in accordance with the present invention.
Figure 9:
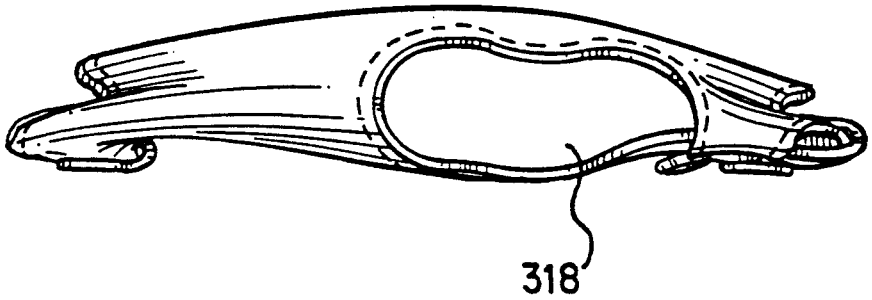
FIG. 9 illustrates a bottom view of a belt holster in accordance with the present invention.

Referring now to FIGS. 3 and 4, front and rear views of pocket holster 200 are described. Pocket holster 200 comprises an inner face 202 and an outer face 204 formed of a single piece of material (e.g., planar sheet material) folded along a fold line 214 or, alternatively, pocket holster 200 is formed of a single piece of material such as injection molded plastic. The inner face is adjacent the wearer's leg when the holster is inserted in the pocket. Outer and inner faces 204 and 202 are spaced to form a gap 220 therebetween for receipt of weapon 100. Inner face 202 comprises at least one arm 208. In the illustrated embodiment, an optional upper arm 206 and a lower arm 208 are provided. Both arms are not, however, necessary. Upper arm 206 can be used to contain a midsection of the weapon.

Upper and lower arms 206 and 208 have extensions which extend generally parallel to one another. Ends of the upper arm and lower arm extensions are fastened to an inward facing surface of outer face 204 by fasteners 210 and 212, respectively. Lower arm 208 limits the depth by which weapon 100 can be inserted into holster 200.

Lower arm 208 has an upper edge 222 providing a rest upon which a face of a weapon cylinder, for a revolver, or a front strap of a trigger guard, for a semi-automatic weapon, rests upon insertion of weapon 100 into holster 200. The upper edge 222 also governs the depth to which weapon 100 is seated within holster 200.

The outer face 204 of holster 200 forms a smooth surface facing away from the body of the wearer of holster 200. The smooth surface of outer face 204 conceals the presence of weapon 100 within holster 200.

The outer face 204 of holster 200 has a shape which facilitates insertion of holster 200 into a pocket. In this example, lower rounded corner 216 generally conforms to the shape of the pocket and facilitates insertion of the holster into the pocket. Outer face 204 of holster 200 further includes an upper square corner 218 which engages an interior of a pocket, thus retaining holster 200 within the pocket, particularly as weapon 100 is pulled from holster 200.

Pocket holster 200 thus provides concealment for weapon 100 retained therein while controlling depth of insertion and facilitating rapid removal of weapon from holster 200.

Referring now to FIGS. 5-10, a belt holster 300 according to the present invention is described. Belt holster 300 comprises an outer face 302 and an inner face 304. Outer and inner faces 302 and 304 can be formed of a single piece of material such as a planar sheet of folded material (e.g., leather) folded along fold line 306. Alternatively, outer and inner faces 302 and 304 can be formed of a single piece of material such as injection molded plastic. Outer face 302 and inner face 304 are spaced to form a gap therebetween for receipt of weapon 100.

Upper edges 308 and 310 of outer face 302 and inner face 304, respectively, define a large opening 316 through which weapon 100 is inserted into and removed from holster 300. Lower edges 312 and 314 of outer face 302 and inner face 304, respectively, define a smaller opening 318 through which a weapon's barrel 102 or forwardmost slide portion extends.

Outer face 302 includes tabs 320, 322 and 324, which extend around to an inward facing surface of inner face 304, and are fastened to the inward facing surface of inner face 304 by, fastening means 326, 328 and 330. Outer face 302 further includes curved slots 340 and 342, slots 340 and 342 curving outwardly towards side edges of outer face 302.

Inner face 304 of holster 300 includes tabs 348 and 350 extending from side edges of inner face 304. Slots 344 and 346 are provided in inner face 304. Tabs 348 and 350 extending from inner face 304 extend around an outward facing surface of outer face 302, through slots 340 and 342, respectively, of outer face 302 and through slots 346 and 344, respectively, of inner face 304. Ends 352 and 354 of tabs 350 and 348, respectively, are fastened to the inward facing surface of inner face 304 by fastening means 356 and 358.

The location of the tabs maintains the position of weapon 100 in all degrees of freedom, thus preventing rotation of weapon 100 around the horizontal axis when weapon 100 is positioned within holster 300. The tabs further define the location and size of openings 316 and 318, thus determining the degree of weapon cant within holster 300. The front strap of the revolver's frame or front strap of the semi-automatic's trigger guard will abut the fold line 306, thus determining the depth to which weapon 100 is seated within holster 300 and the necessary degree of cant of the weapon 100 within holster 300.

When holster 300 is worn, a belt passes through offset slots 340 and 346, beneath the inward facing surface of inner face 304 and through slots 344 and 342. The slots 344 and 346 are located a first predetermined distance from side edges 360 and 362 of inner face 304. Slots 342 and 340 in outer face 302 are preferably located a second predetermined distance from side edges 364 and 366, respectively, of outer face 302. The location of the slots in outer face 302 and inner face 304 provides friction against an outward facing surface of a belt slid therethrough, thus maintaining the position of holster 300 on the belt. Slots 340 and 342 are preferably curved to introduce yet another frictive force against a surface of the wearer's belt to further prevent holster 300 from sliding laterally along the belt. Further, the area of the faces 302 and 304 above and below the slots provides a force between the holster faces pulling them snugly against an outer surface of weapon 100 when holster 300 is worn on a belt, thus ensuring retention of weapon 100 within holster 300.

Figure 10:
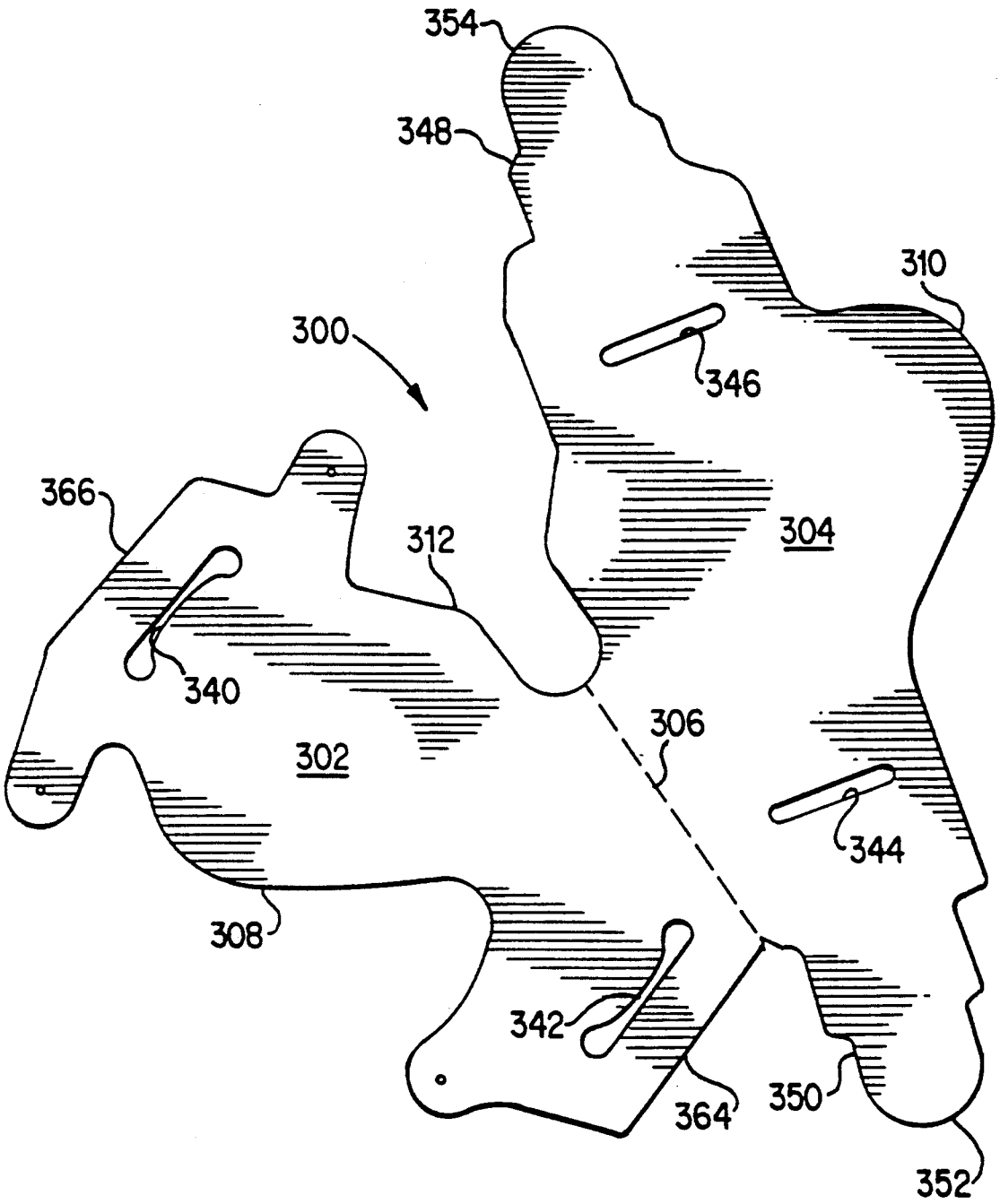
FIG. 10 illustrates a plan view of the belt holster of FIGS. 7-9.

FIG. 10 illustrates a "face" side of a right-handed version of a belt holster 300 (upside-down).

Figure 11A:
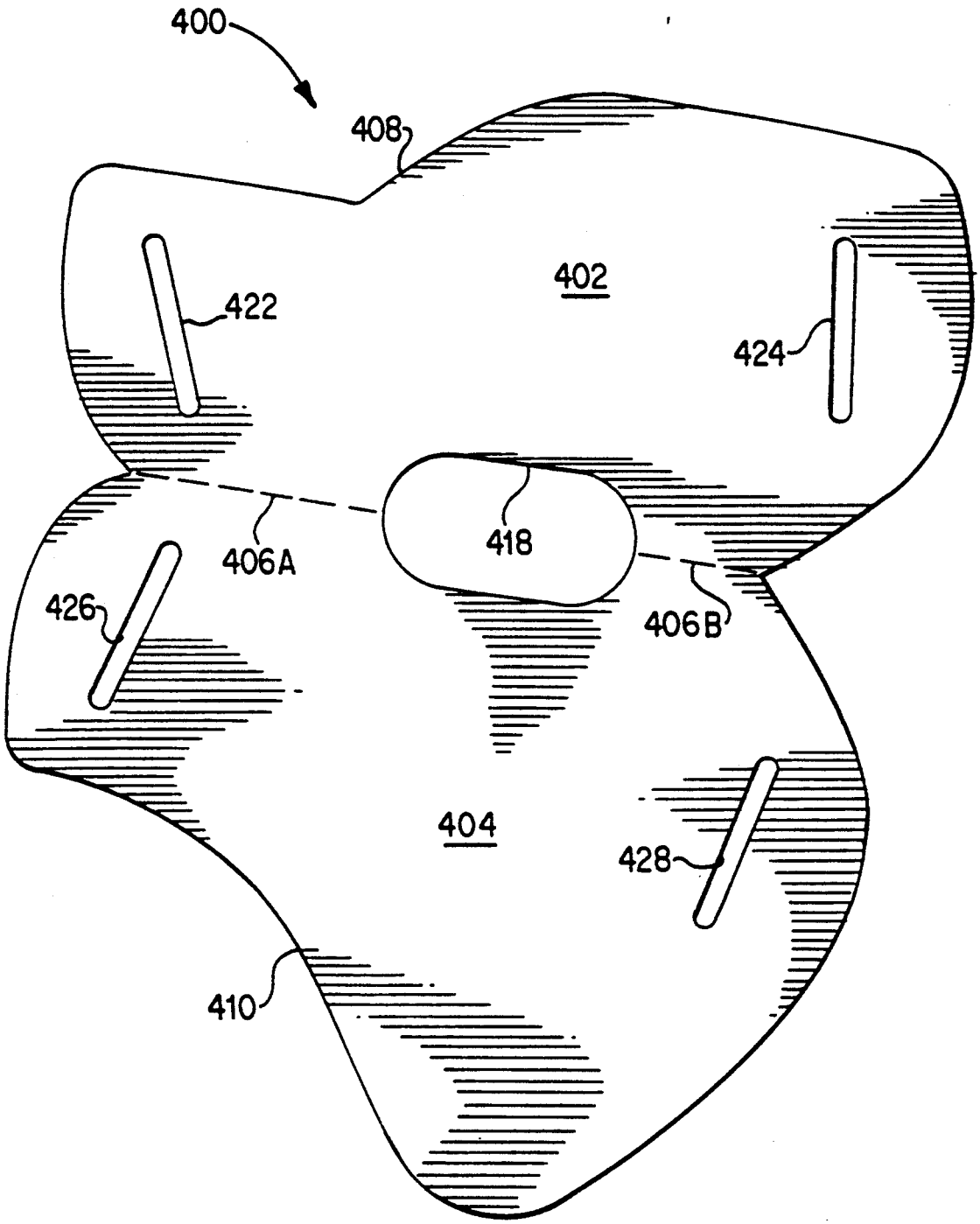
FIG. 11A illustrates a plan view of another embodiment of a belt holster according to the present invention.
Figure 11B:
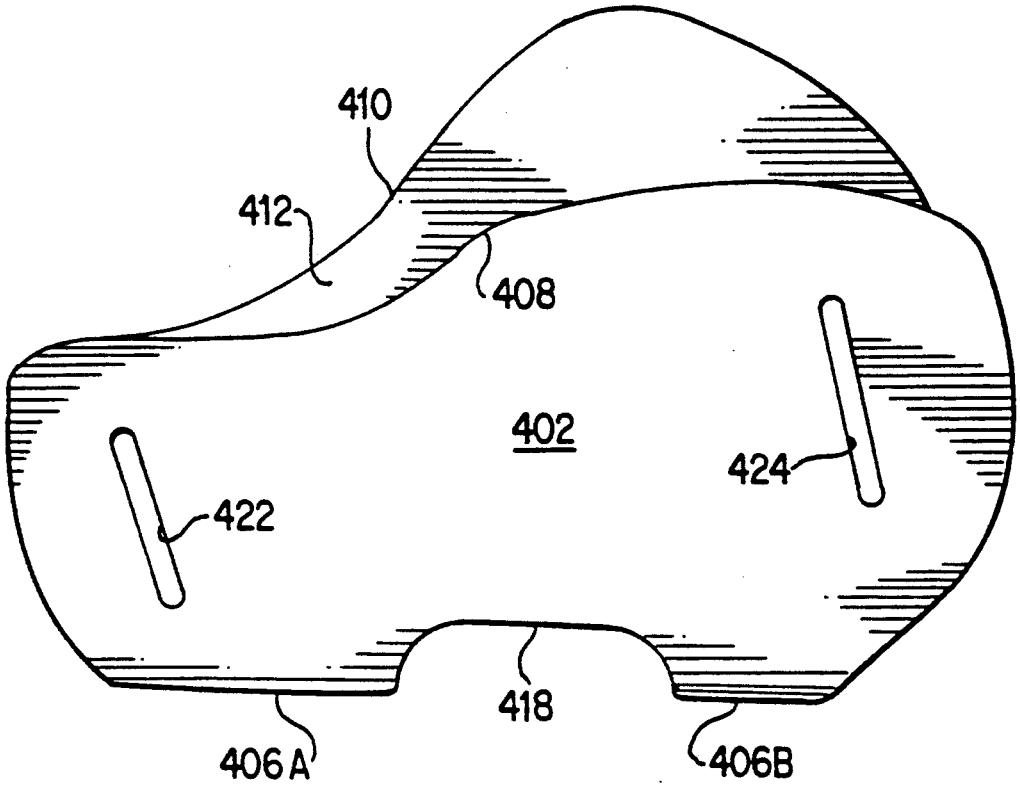
FIGS. 11B and 11C illustrate front and rear views, respectively, of the belt holster of FIG. 11A.
Figure 11C:
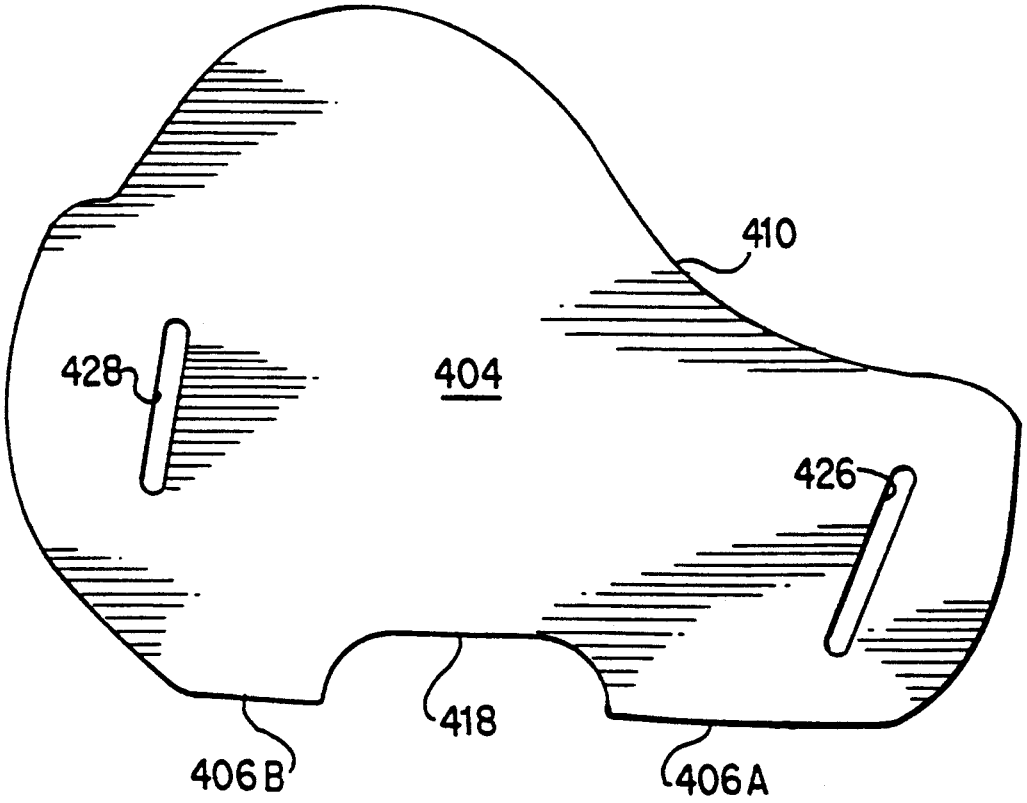

Referring now to FIGS. 11A-11C, another embodiment of a belt holster according to the present invention is described. Belt holster 400 comprises an outer face 402 and an inner face 404. Outer and inner faces 402 and 404 can be formed of a single piece of material such as a planar sheet of folded material (e.g., planar sheet material) folded along fold lines 406A and 406B. Alternatively, outer and inner faces 402 and 404 can be formed of a single piece of material such as injection molded plastic. Outer face 402 and inner face 404 are spaced to form a gap therebetween for receipt of weapon 100.

Upper edges 408 and 410 of outer face 402 and inner face 404, respectively, define an opening 412 through which weapon 100 is inserted into and removed from holster 400. Lower edges of outer face 402 and inner face 404, respectively, define an opening 418 through which a weapon barrel or forwardmost slide portion 102 extends.

Outer face 402 includes slots 422 and 424. Inner face 404 includes corresponding slots 426 and 428.

When holster 400 is worn, a belt passes through slots 424 and 428, beneath the inward facing surface of inner face 404 and through slots 426 and 422. As illustrated in FIG. 11A, the orientation of the slots 422, 424, 426 and 428 and the location of opening 418 are such that, when a belt passes through slots 424 and 428, beneath the inward facing surface of inner face 404, and though slots 426 and 422, and when weapon 100 is positioned in holster 400, the longer fold section 406A determines the necessary degree of weapon cant of the weapon 100 within holster 400. The front strap of the revolver's frame or the front strap of the semiautomatic's trigger guard will abut the longer fold line 406A, thus determining the depth to which weapon 100 is seated within holster 400 and the degree of weapon cant within holster 400. The location of the slots in outer face 402 and inner face 404 provides friction against a surface of a belt slid therethrough, thus maintaining the position of holster 400 on the belt. The area of the faces 402 and 404 in front of and behind the slots also provides a force between the holster faces pulling them snugly against an outer surface of weapon 100 when holster 400 is worn on a belt, thus ensuring retention of weapon 100 within holster 400.

The holsters of the present invention thus provide a plurality of features desirable to a holster wearer. The holsters are formed of substantially stitchless one-piece construction, thus simplifying the manufacture of the holsters. Accordingly, the gun holsters can be economically manufactured.

The holsters provide secure retention of weapons held therein. Simultaneously, the holsters facilitate release of weapons held therein for quick weapon withdrawal by the holster wearers. Further, the holsters are constructed to facilitate concealment of weapons held therein. In accordance with all of these features, a holster wearer can feel secure in carrying weapons within the holsters.

While this invention has been described in conjunction with specific embodiments thereof, it is evident that many alternatives, modifications and variations will be apparent to those skilled in the art. For example, while the holsters are described as having a stitchless construction, stitching can be used in conjunction with the holsters. Stitching is not, however, necessary to connect the holster faces. While the disclosed holsters are for right-handed wearers, the holsters can be adapted for use by left handed wearers. While tabs have been disclosed as means for connecting outer and inner holster faces, it should be understood that other fastening means can be used. Further, while a leather material is used as an exemplary material, any material having the required flexibility to conform to the weapon, conform to the holster wearer's body and retain the weapon therein can be used. For example, a single piece of material such as an injection molded plastic can be used as the desired material. The holsters have also been illustrated with weapons such as a revolver, but it is evident that they are applicable to semi-automatic weapons as well. Accordingly, the preferred embodiments of the invention as set forth herein are intended to be illustrative, not limiting Various changes may be made without departing from the spirit and scope of the invention as defined in the following claims.

What is claimed is:

1. A belt holster, comprising:

an outer face having outward and inward facing surfaces, and upper, lower and two side edges;

an inner face having outward and inward facing surfaces, and upper, lower and two side edges, said inner face being connected to said outer face, said outer and inner faces being spaced along portions thereof to form a gap therebetween for receipt of a weapon;

a first opening provided at said upper edges of said outer and inner faces, said first opening being adapted to receive the weapon;

a second opening provided at said lower edges of said outer and inner faces, said second opening being adapted to receive one of a revolver's barrel and a semi-automatic weapon's forwardmost slide portion;

two slots in said outer face, each of said outer face slots being provided adjacent to one of said outer face side edges;

two slots in said inner face, each of said inner face slots being provided adjacent to one of said inner face side edges;

said outer face slots and inner face slots cooperating to receive a belt passing in a belt direction through one of said two outer face slots and an adjacent one of said two inner face slots, said belt extending along the inward facing surface of said inner face and through the other of said two inner face slots and the adjacent other of said two outer face slots; and attachment means by which said inner and outer faces are attached to one another, wherein the gap between the inner and outer faces extends in the belt direction between the outer and inner face slots.

2. The belt holster according to claim 1, wherein;

said first opening is a large opening and said second opening is smaller than said first opening;

said outer face upper edge having first and second tabs extending therefrom said first and second tabs being located adjacent to said large opening, each tab being provided at an opposite end of said outer face upper edge, said first and second tabs being fastened to said inward facing surface of said inner face;

said outer face lower edge having a third tab extending therefrom, said third tab being located adjacent to said smaller opening, said third tab being provided at an end of said outer face lower edge and being fastened to said inward facing surface of said inner face; and said inner face has a tab extending from each of said inner face's two side edges, each of said two inner face side edge tabs passing around said outward facing surface of said outer face through said adjacent outer face side edge slot, said inner face side edge tabs being fastened to said inward facing surface of said inner face.

3. The belt holster according to claim 1, wherein said holster comprises a planar sheet material.

4. The belt holster according to claim 3, wherein said material is a single piece of stitchless folded material.

5. The belt holster according to claim 1, wherein said holster comprises a single piece of molded material.

6. The belt holster according to claim 1, wherein said inner face slots are located a first predetermined distance from each of said inner faces two side edges and said outer face slots are located a second predetermined distance from said outer face side edges, said second predetermined distance being larger than said first predetermined distance.

7. The belt holster according to claim 1, wherein said outer face slots are curved in an outward direction toward and adjacent outer face side edge.

8. The belt holster according to claim 1, wherein said inner face slots, said outer face slots and said lower opening are oriented to provide a necessary degree of weapon cant when the weapon is adapted to be positioned within said holster.

9. A belt holster, comprising:

an outer face having outward and inward facing surfaces, and upper, lower and two side edges;

an inner face having outward and inward facing surfaces, and upper, lower and two side edges, said inner face being connected to said outer face, said outer and inner faces being spaced along portions thereof to form a gap therebetween for receipt of a weapon;

a first opening provided at said upper edges of said outer and inner faces, said first opening being adapted to receive the weapon;

a second opening provided at said lower edges of said outer and inner faces, said second opening being adapted to receive one of a revolver's barrel and a semi-automatic weapon's forwardmost slide portion;

two slots in said outer face, each of said outer face slots being provided adjacent to one of said outer face side edges;

two slots in said inner face, each of said inner face slots being provided adjacent to one of said inner face side edges;

said outer face slots and inner face slots cooperating to receive a belt passing in a belt direction through one of said two outer face slots and an adjacent one of said two inner face slots, said belt extending along the inward facing surface of said inner face and through the other of said two inner face slots and the adjacent other of said two outer face slots; and attachment means by which said inner and outer faces are attached to one another;

wherein said inner face slots are located a first predetermined distance from said inner face side edges and said outer face slots are located a second predetermined distance from said outer face side edges, said second predetermined distance being larger than said first predetermined distance.

10. The belt holster of claim 9, wherein the gap between the inner and outer faces extends in the belt direction between the outer and inner face slots.

* * * * *